US010279371B2

(12) United States Patent
Gambini

(10) Patent No.: US 10,279,371 B2
(45) Date of Patent: May 7, 2019

(54) GLUING DEVICE OF AN END EDGE OF A LOG AND RELATIVE GLUING METHOD

(71) Applicant: GAMBINI INTERNATIONAL S.A., Luxembourg (LU)

(72) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 568 days.

(21) Appl. No.: 15/006,957

(22) Filed: Jan. 26, 2016

(65) Prior Publication Data

US 2016/0221029 A1 Aug. 4, 2016

(30) Foreign Application Priority Data

Jan. 29, 2015 (IT) ..... MI2015A000118

(51) Int. Cl.
*B65H 19/29* (2006.01)
*B05D 1/02* (2006.01)
(Continued)

(52) U.S. Cl.
CPC ..... *B05D 1/02* (2013.01); *B05B 9/03* (2013.01); *B65H 18/08* (2013.01); *B65H 19/29* (2013.01);
(Continued)

(58) Field of Classification Search
CPC ..... B65H 19/29; B65H 37/02
See application file for complete search history.

(56) References Cited

U.S. PATENT DOCUMENTS 4,026,752 A * 5/1977 Hartbauer ..... B65H 19/29 156/457
5,800,652 A 9/1998 Vigneau et al.
(Continued)

FOREIGN PATENT DOCUMENTS

DE 102007008996 A1 8/2008
EP 1440925 A1 7/2004
EP 1652804 A1 5/2006

OTHER PUBLICATIONS

IT MI20150118, Italian Search Report, dated Sep. 22, 2015.

*Primary Examiner* — Jeffry H Aftergut
(74) *Attorney, Agent, or Firm* — Ice Miller LLP

(57) ABSTRACT

A gluing device (10) for gluing an end edge (11') of a log (11) comprising, in succession, an introducing group (20) for introducing logs (11) into the gluing device (10), a handling group (30) for handling the log (11) associated with detection means for detecting the end edge (11') and comprising a pair of rollers (31, 32) selectively for advancing and for holding in rotation the log (11), a glue dispensing group (40) and a transferring group (50) for transferring the log (11) comprising a transferring plane (51) arranged downstream of the lower handling roller (32), between the lower handling roller (32) and the transferring plane (51) has a space (35) for the passage of the end edge (11'), the glue dispensing group (40) being arranged below the transferring plane (51) and comprising a transversal row of glue dispensing nozzles (41) are selectively disinsertable and directed towards the lower handling roller (32), and it comprises a transversal alignment device (23) for aligning the log (11) arranged upstream of the glue dispensing group (40).
A related method of gluing the end edge is also part of the invention.

6 Claims, 5 Drawing Sheets

(51) Int. Cl.

| | |
|---|---|
| ***B05B 9/03*** | (2006.01) |
| ***B65H 18/08*** | (2006.01) |
| ***B65H 37/02*** | (2006.01) |
| ***B65H 23/02*** | (2006.01) |

(52) U.S. Cl.
CPC ..... *B65H 23/02* (2013.01); *B65H 37/02* (2013.01); *B65H 2301/414421* (2013.01); *B65H 2301/414436* (2013.01); *B65H 2301/414446* (2013.01); *B65H 2511/12* (2013.01)

(56) References Cited

U.S. PATENT DOCUMENTS

| | | | | |
|---|---|---|---|---|
| 6,372,064 | B1 * | 4/2002 | Butterworth ..... | B65H 19/29<br>156/187 |
| 2014/0131498 | A1 * | 5/2014 | Brokopp, Jr. ..... | B65H 19/29<br>242/160.4 |
| 2015/0020976 | A1 | 1/2015 | Yen | |

* cited by examiner

GLUING DEVICE OF AN END EDGE OF A LOG AND RELATIVE GLUING METHOD

CROSS-REFERENCE TO RELATED APPLICATIONS

The present application is related to and claims the priority benefit of Italian Patent Application Serial No. MI2015a000118, filed Jan. 29, 2015, the text and drawings of which are hereby incorporated by reference in their entireties.

The present invention relates to a gluing device of an end edge of a log and to a relative gluing method.

A gluing device of an end edge of a log is the machine that through the deposition of glue carries out the closing of the end edge of rolls of paper for domestic use, toilet paper and the like, usually referred to as "logs", previously made by a rewinder by wrapping one or more plies of paper on a cardboard core. The log with the end edge stably bound with a certain amount of glue is then cut into a plurality of small rolls, the so-called "little rolls", into a cutting machine.

The technology of the '80 s was to open the edge of the log on the advancing plane and dispense a predetermined amount of glue on the edge of the log open on the advancing plane through a nozzle of glue that moved parallel to the log itself. Then, the edge carrying the glue was closed again on the log and the log was made to rotate on itself through a pair of rollers to give consistency to the gluing of the paper.

The main drawbacks of such technical solutions were the limits of speed due to the transverse movement of the nozzle, as well as the imprecise glue spraying due to the necessary distance provided between the nozzles and the edge unwound on the feeding plane.

Thereafter, to increase the speed of the machine in terms of log per minute, gluing devices were used which dispense the glue directly on the log open beforehand, namely after having unwound the end edge, to then close the log to obtain the gluing of the edge on the log carrying the glue. In these machines, the dispensing of the glue for example takes place by the passage of the log by rolling on a slot from which the dosed dispensing of the glue occurs by overflowing or by drawing of the glue by the log from an element that carries glue through a linear element or blade, which is dipped in the glue and transfers the glue to the log.

The main drawback of this system is a fairly important contamination of the log glue, since the glue passes within the log through several windings, causing difficulty in opening the log when used, with consequent lowering of the product quality.

The difficulty of these known gluing devices of the end edge in dispensing and distributing the glue with uniformity, in a dosed amount and exactly in the desired position further creates a greater consumption of glue.

It follows that these drawbacks have an impact first and foremost on the quality of the produced logs, which ideally should have only the end edge glued and not also the subsequent windings, as well as on the quality of the subsequent cutting of the little rolls, which tend to open if the cut is not located in close proximity to the glued portion.

Even the efficiency of the machines is affected for example by the risk of soiling the components of the gluing device with the excess glue and thus the logs fed thereafter, causing downtime for maintenance.

In the subsequent cutting of the little rolls, moreover, opening a scrap roll, referred to as trim, not properly glued would cause downtime of the cutting machine.

In addition to these drawbacks, it should be noted that the gluing devices of the end edge of a log are particularly complicated both from the constructive point of view and from the point of view of the action carried out among the various parts that make the log advance, the end edge unwind, at least in a portion thereof, and position the glue. In fact, after being unwound from the log by the predetermined amount, the end edge must be phased and kept in phase, especially with the glue dispenser during its transfer towards such a dispenser.

The aim of the present invention is to provide a gluing device of an end edge of a log and a relative gluing method that solves the above technical drawbacks of proper dispensing of the glue and correct phasing of the unwound end edge.

Another aim of the present invention is to provide a gluing device of an end edge of a log and a relative gluing method that allows an accurate and simple adaptation to the width of the logs being formed.

Another aim of the present invention is to provide a gluing device of an end edge of a log and a relative gluing method that is particularly simple and functional, as well as cost-effective.

These aims according to the present invention are achieved by providing a gluing device of an end edge of a log and a relative gluing method as set out in the independent claims.

Further features are provided in the dependent claims.

The features and the advantages of a gluing device of an end edge of a log and a relative gluing method according to the present invention will become more apparent from the following exemplary and non-limiting description, made with reference to the accompanying schematic drawings, in which.

FIGS. 4A-4D schematically show the steps of the gluing method according to the invention.

Figure 1:
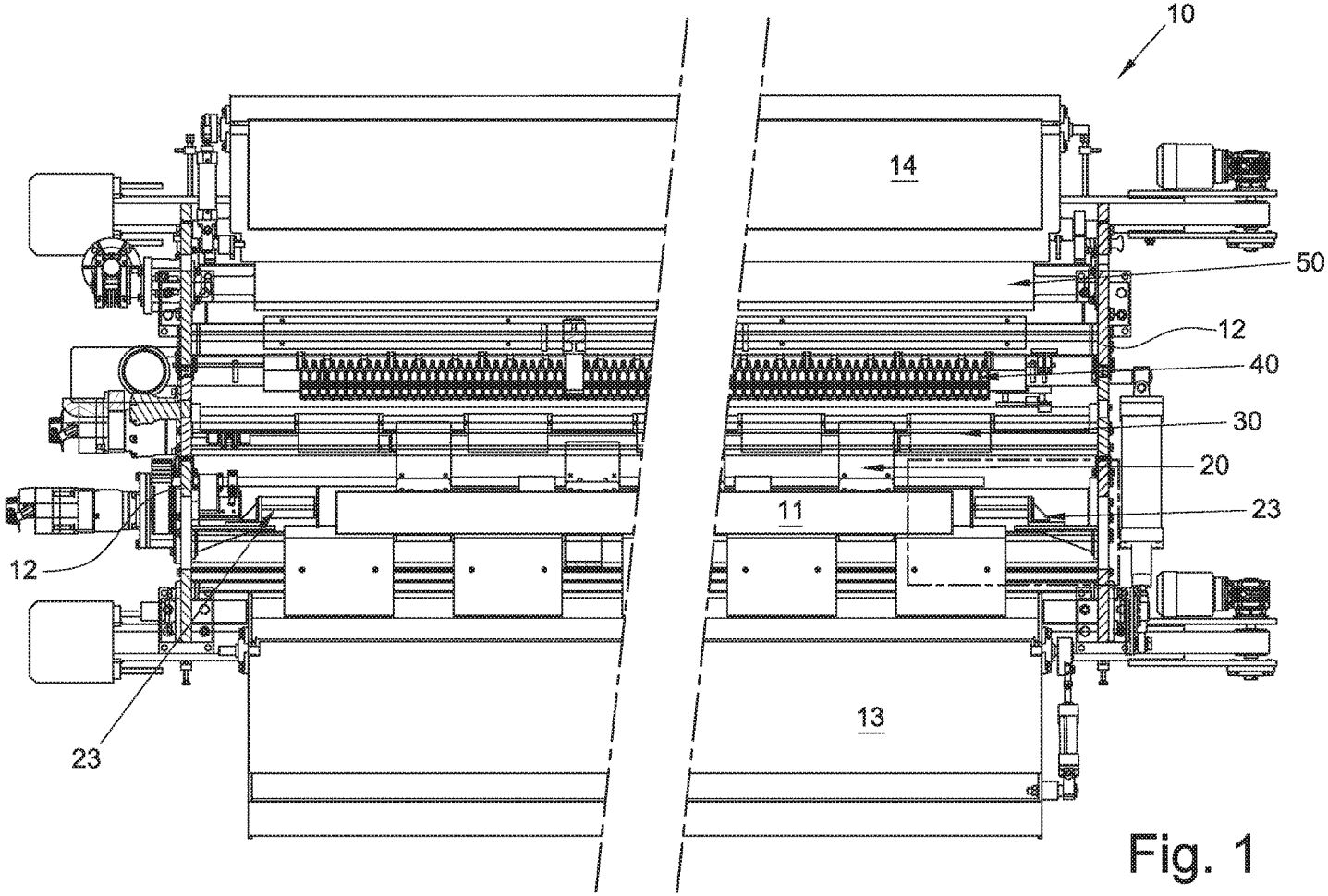
FIG. 1 is a plan, partially sectional view of a gluing device of an end edge of a log.
Figure 2:
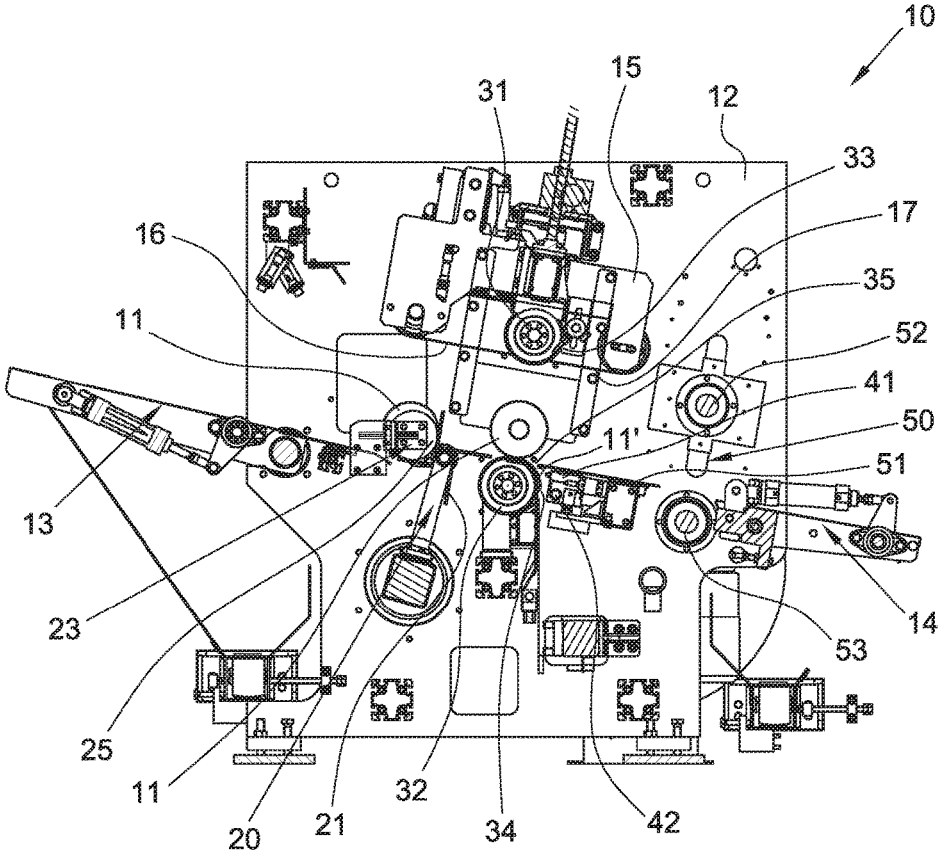
FIG. 2 is a partially sectional side elevation view of FIG. 1.

With reference to the figures, a gluing device of an end edge of a log is shown, globally indicated with reference numeral 10, shown as a whole in FIGS. 1 and 2.

In the gluing device of the end edge 10 according to the invention one inlet side of a bearing structure comprising two sidewalls 12 is provided with an inclined feeding plane 13, for feeding logs 11, provided with free end edge 11' and coming from a previous rewinding machine (not shown) arranged upstream.

In succession from upstream to downstream, following the advancement of logs 11, the gluing device of the end edge 10 comprises an introducing group 20 for introducing logs 11 one after the other, a handling group 30 for handling the logs 11, a glue dispensing group 40 and a transferring group 50 for transferring the logs 11.

On an opposite outlet side of the gluing device 10, an inclined unloading plane 14 carries logs 11 provided with glued end edge 11' to a subsequent cutting station (not shown).

As an exemplary embodiment, the introducing group 20 may include an intermittent rotary selector 21 of the star type, in the example provided with four receiving elements which receive single logs 11 in input and feed them one after the other in output towards the handling group 30.

The handling group 30 for handling the logs 11 includes a pair of rollers 31 and 32 arranged one above the other, respectively an upper handling roller 31 and a lower handling roller 32, provided with independent motors to impart a rolling without advancing to log 11, as well as the advancement beyond them. The handling rollers 31 and 32 have the task of both unwinding the end edge from the log and of rewinding it after the dispensing of glue.

In particular, the pair of handling rollers 31 and 32, while imparting a rolling without advancement to log 11 to unwind the end edge 11', cooperates with a series of air nozzles 33, arranged superiorly, which open the end edge 11' from log 11, stretching it on a surface immediately downstream of the lower handling roller 32 in a position below an advancing plane of logs 11. According to the preferred embodiment of the invention shown, this surface consists of a curved lower plane 34 immediately downstream of the lower handling roller 32. By "advancing plane of the logs", schematically shown with a dashed-dotted line F in the figures, it is not meant a material element, but a succession of surfaces that support logs 11 advancing through the gluing device 10.

In the example, the advancing plane includes the upper cylindrical directrix of the lower handling roller 32 and a transferring plane 51, inclined in the example, placed downstream of the pair of rollers 31 and 32 and of the glue dispensing group 40.

A space 35 for the passage of the end edge 11' is provided between the lower handling roller 32 associated with the curved lower plane 34 and the transferring plane 51.

In the gluing device 10 according to the invention, the glue dispensing group 40 is placed below the advancing plane of the logs, and in particular below the transferring plane 51.

The transferring group 50 of the logs comprises, downstream of the transferring plane 51 placed at the outlet of the glue dispensing group 40, a pair of pressure rollers 52 and 53, arranged one above the other and motorized independently to impart the pressure for gluing and the possible phasing of the glued end edge 11' according to the successive working station placed after the unloading plane 14.

According to known ways, in the gluing device 10 according to the invention, the upper handling roller 31 is mounted on a slide 15 adjustable in height, shown in FIG. 2 in the raised position. In addition, the upper handling roller 31 also forms the return roller of a series of inlet belts 16 and a series of outlet belts 17, arranged superiorly respectively to facilitate the transfer of logs 11 from the introducing group 20 to the pair of handling rollers 31 and 32, as well as the subsequent transfer to the transferring plane 51. According to a further embodiment, not shown, such series of upper belts 16 and 17 may be made as a series of a unique belt or they may be entirely or partly omitted.

According to the invention, the glue dispensing group 40 comprises a transversal row of glue dispensing nozzles 41, placed below the transferring plane 51 in a fixed position with its axis substantially parallel to the advancing plane and spraying direction directed towards the lower handling roller 32 and in particular towards the curved lower plane 34.

The gluing device 10 according to the invention comprises detection means for detecting said end edge which, according to the preferred embodiment shown, consist of photocells 42, arranged substantially parallel to the advancing plane, which detect the presence of the end edge 11' on the curved plane 34 according to a predetermined length for controlling the dispensing of glue and the rewinding by means of the handling rollers 31 and 32.

The glue dispensing nozzles 41 are preferably connected to a unique tank containing glue and are controlled for the intermittent dispensing of glue at spots 43.

The row of glue dispensing nozzles 41 has a transversal extension equal to the maximum possible width of the logs being processed, having to ensure the dispensing of the glue as close as possible to the end edges of the logs.

The row of glue dispensing nozzles 41 consists of glue dispensing nozzles 41 selectively disinsertable individually, or in groups, to exclude the dispensing of glue in some predetermined portions of the transversal row. In particular, this allows deactivating nozzles 41 at the ends of the row when logs with different formats are being processed, and in particular having a width less than the maximum possible width.

Through the selective deactivation of individual or groups of glue nozzles 41 it is also possible to provide for the presence of log portions without glue at any predetermined position, for example for subsequently making the cut in the cutting machine at portions without glue.

The deactivation of the glue nozzles 41 at the ends of the transversal row, according to the format of the log to be treated, is essential to prevent spraying the glue directly on the lower curved plane 34 where there is no paper. However, this solution is resolutive only if logs 11 are fed to the glue dispensing group 40 perfectly centred, that is to say, axially aligned according to a reference position corresponding with the position of the active glue nozzles 41.

However, the feeding of logs 11 to the gluing device 10 through the rolling on the inclined feeding plane 13 is by nature imprecise and frequently causes the displacement of the logs in the transversal direction and the consequent misalignment with respect to the outlet of the logs from the rewinding machine, which constitutes the reference positioning of the logs. As a result of the misalignment of the logs with respect to the reference positioning, there would be the spraying of glue directly on the curved lower plane 34 at one end and a corresponding portion of log completely without glue at the opposite end.

To solve the problem of positioning logs 11, the glue dispensing group 40 of the gluing device 10 according to the invention is provided with a transversal alignment device 23 located upstream of the glue dispensing group 40 and preferably associated with the log introducing group 20.

The transversal alignment device 23 comprises a pair of linear actuators 24 symmetrically applied to sidewalls 12 of the gluing device 10 and acting according to a symmetrical motion along an axis parallel to the axis of logs 11. Actuators 24 are arranged laterally with respect to the introducing group 20, and in particular laterally to the rotary selector 21 on the loading side of logs 11 coming from the feeding plane 13 (FIG. 1).

Figure 3A:
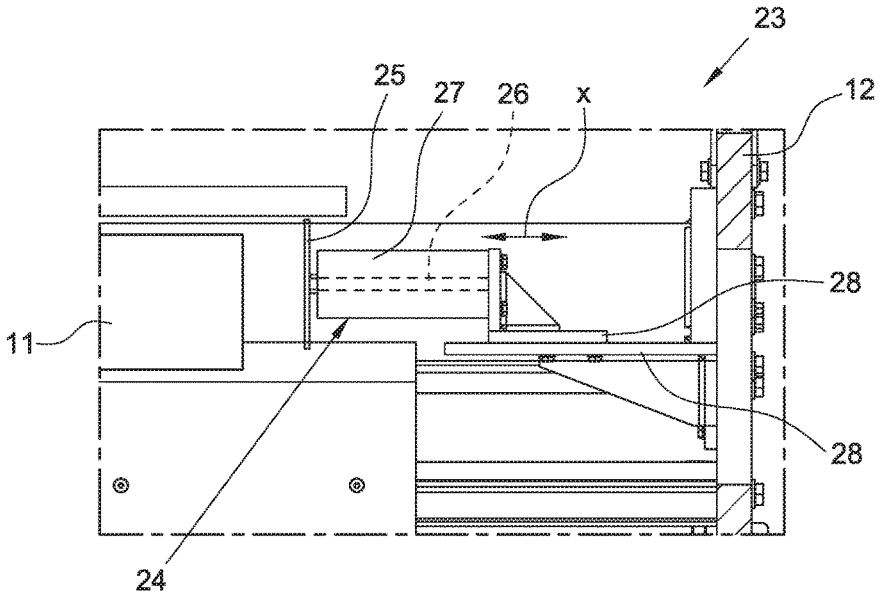
FIG. 3A is an enlarged detail of FIG. 1 showing a log loaded and not yet aligned.
Figure 3B:
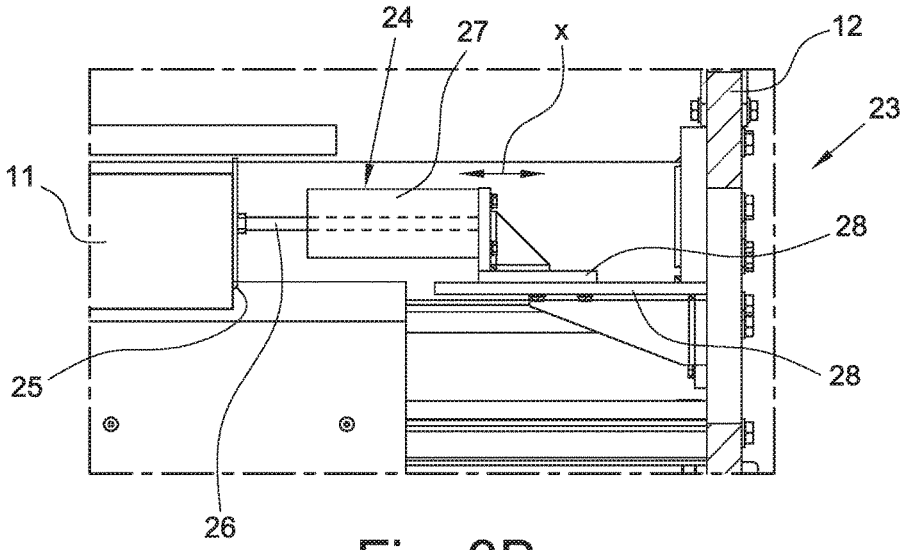
FIG. 3B shows, as an enlarged detail, the log in FIG. 3A during the alignment.

Actuators 24 include an abutment element 25 for the pressure on the flat sidewall of the logs, for example a flat plate, connected to the end of a stem 26 operable between two predetermined end-stroke positions, that is to say, between an open position to receive the log (FIG. 3A) and a closed position for centering the log (FIG. 3B).

According to a preferred embodiment, stem 26 is a piston movable in a pneumatic cylinder 27. The flat plate 25, of circular shape in the example, is preferably made of suitable size to cooperate with logs of different diameters in use, or it may be replaceable.

The adjustment of the opening and closing end-stroke position is for example obtained by mounting the actuator 24 axially adjustable to sidewalls 12 by using two support plates 28, connected to each other by a slot, not shown, which allows the axial adjustment as schematically shown with the double arrow X in the figure.

When the log coming from the inclined feeding plane 13 arrives on the rotary selector 21, the two opposite linear actuators 24, which are located in the open end-stroke position, simultaneously move with converging motion to the closed end-stroke position, thus leaning on the sidewalls of the log and axially displacing it, if misaligned, up to centre it in the desired position. To release the centred log, the two linear actuators 24 then simultaneously move with diverging motion to the open end-stroke position, ready to receive the next log 11.

According to a preferred operating mode, the linear actuators 24 act on all the logs fed without evaluating the actual need of centering in advance.

According to a preferred embodiment of the invention, the two actuators work simultaneously with symmetrical converging/diverging motion, but equivalent solutions may be envisaged in which, for example, one side is fixed, possibly adjustable, and only one linear actuator is required.

As an alternative to the preferred solution described, the actuators may work against an adjustable abutment, without needing the connection through a slot between the two support plates 28 for adjusting the log format being processed.

An object of the invention is also a relative gluing method of an end edge of a log, wherein each log 11 fed to the gluing device 10 of the end edge is subject to the following steps in succession, before being unloaded therefrom, as shown schematically in FIGS. 4A-4D:

- axial alignment of log 11 with respect to a reference position corresponding to the position of the row of active glue nozzles 41;
- opening and unwinding the end edge 11' between the pair of handling rollers 31 and 32;
- stretching the end edge by a predetermined length on a surface arranged below the advancing plane of the logs, in the example the curved lower plane 34, and spraying glue onto the end edge 11' in a direction substantially parallel to the advancing plane of the logs through the glue spraying nozzles 41 preselected from a transversal row of nozzles;
- rewinding the end edge 11', carrying glue, through the same pair of handling rollers 31 and 32;
- advancing the log on a transferring plane 51.

Figure 4A:
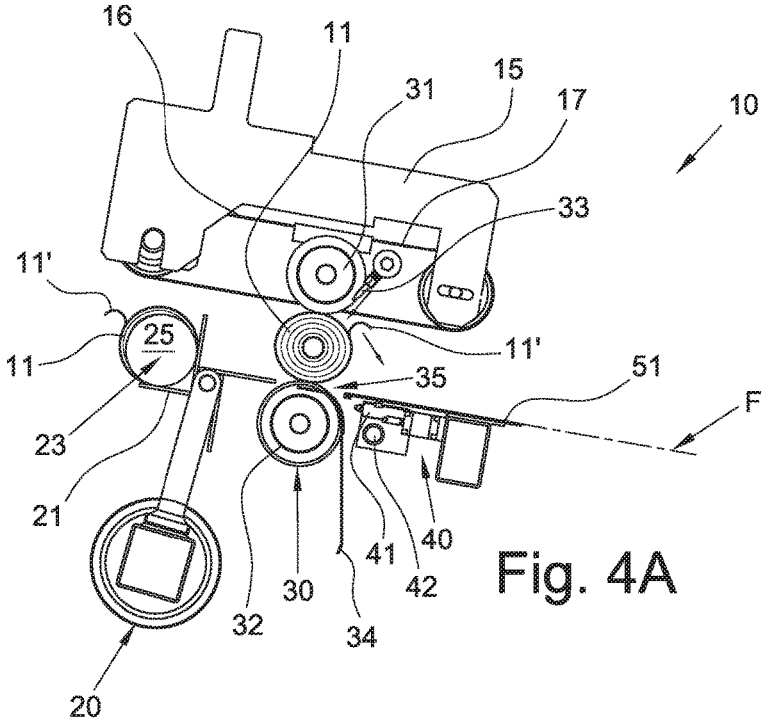
Figure 4B:
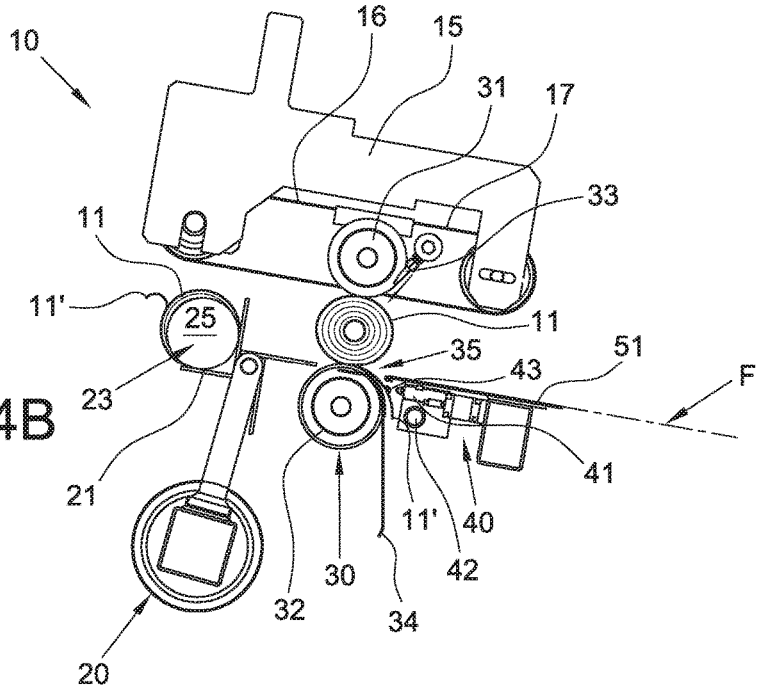
Figure 4C:
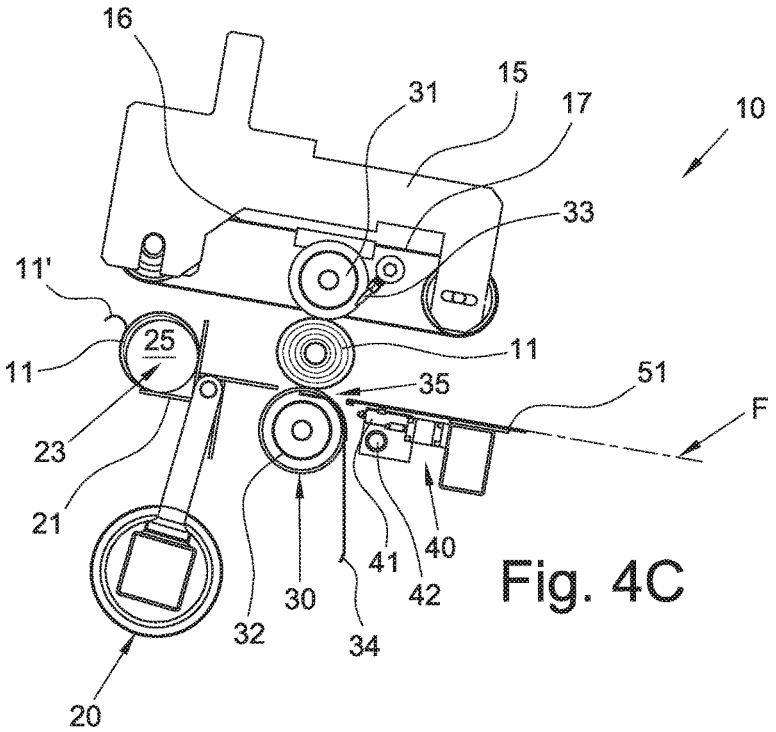
Figure 4D:
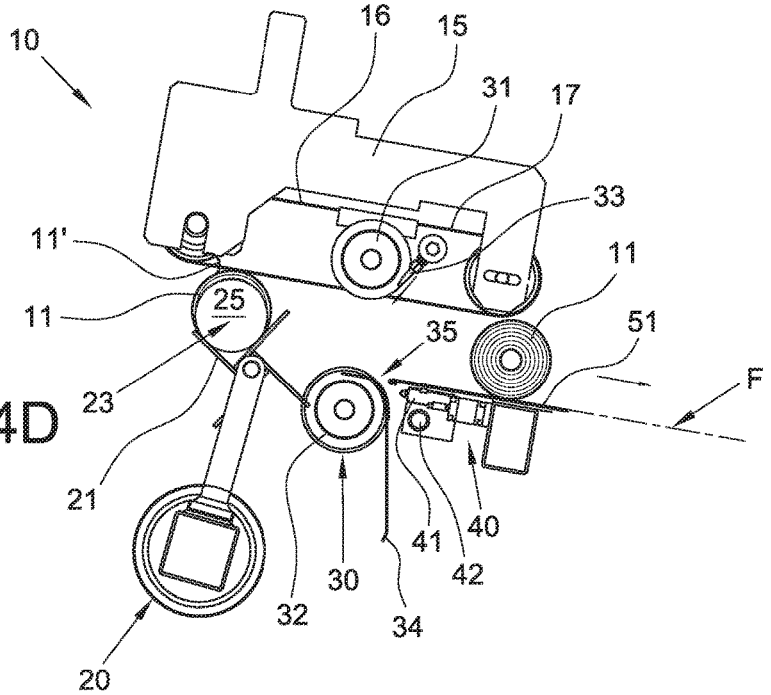

By way of graphic representation only, in FIG. 4B the end edge 11 is depicted slightly spaced apart from the curved lower plane 34, instead than adhering thereon.

The axial alignment of the logs is preferably carried out in the introducing group 20 by axially displacing the logs through pressure onto their lateral surfaces.

The axial alignment, according to a preferred mode of the method object of the invention, is carried out on a log waiting in the introducing group 20 at the same time as the execution of the steps of opening the edge, spraying glue and rewinding the edge of a previous log 11 being processed in the handling group 30.

The axially aligned log is then introduced in the handling group 30 when the previous log 11 with the glued end edge is on the advancing plane 51.

A step of detecting the end edge 11', which in the preferred embodiment is stretched on the curved lower plane 34, takes place by means of photocells 42 and is advantageously provided for controlling the activation of the glue nozzles 41.

According to the invention, the correct positioning on the curved lower plane 34 of the end edge 11' to be glued may also be carried out and controlled by equivalent solutions, for example through the detection of the end edge position before the introduction of the same in the space 35 between the curved plane 34 and the transferring plane 51 and the subsequent phasing check.

The gluing device of an end edge of a log and the relative gluing method object of the present invention have the advantage of allowing a very quick gluing. In fact, the gluing device is very compact as it provides for few transfers between few subsequent processing groups. Moreover, the dispensing of glue through spray nozzles can be controlled very quickly. The initial centering step is also advantageously carried out while the log is waiting on the rotary selector and therefore it does not cause an extension of the processing times.

A further advantage relates to the accuracy in spraying of the glue, obtained by approaching the nozzles very much to the curved lower plane on which the end edge is unwound, a solution that is possible by positioning the glue dispensing group below the log advancing plane.

Advantageously, by carrying out the steps of unwinding the edge, gluing and rewinding the edge on the same handling rollers, any additional phasing steps of the free end edge are unnecessary.

The gluing device and the method object of the present invention also allow a considerable saving of glue, counted around 60% compared to the traditional applicators of an axial glue line on the log, since it is given in less amount of glue on a lower surface.

The gluing device of an end edge of a log and the relative gluing method thus conceived can be subject to several modifications and variants, all falling within the invention; moreover, all the details can be replaced by technically equivalent elements. In the practice, the materials used as well as the sizes, can be whatever, according to the technical requirements.

The invention claimed is:

1. Gluing device (10) for gluing an end edge (11') of a log (11) comprising, in succession, an introducing group (20) for introducing said logs (11) one after the other into said gluing device (10), a handling group (30) for handling said log (11) associated with detection means for detecting said end edge (11') and comprising a pair of rollers (31, 32) arranged one above the other, said pair of rollers (31, 32) being selectively for advancing and for holding in rotation said log (11), a glue dispensing group (40) and a transferring group (50) for transferring said log (11) comprising a transferring plane (51) arranged downstream of said lower handling roller (32), characterised in that between said lower handling roller (32) and said transferring plane (51) there is a space (35) for the passage of the end edge (11'), and in that said glue dispensing group (40) is arranged under said transferring plane (51) and comprises a transversal row of glue dispensing nozzles (41), which are directed towards said lower handling roller (32), wherein said nozzles (41) are selectively disinsertable, as well as in that it comprises a transversal alignment device (23) associated with said introducing group (20) for aligning said log (11) arranged upstream of said glue dispensing group (40), wherein said transversal alignment device (23) comprises a pair of linear actuators (24) applied symmetrically to the sidewalls (12) of said gluing device (10) and equipped with converging/diverging symmetrical motion along an axis parallel to the axis of the log (11).

2. Device according to claim 1, characterised in that said transversal alignment device (23) is associated with said introducing group (20), in particular laterally to a rotary selector (21) on the loading side of the logs (11).

3. Device according to claim 1, characterised in that said linear actuators (24) are two pneumatic actuators, wherein each cylinder (27) is mounted at said sidewalls (12) in an axially adjustable position and wherein each piston (26) bears an abutment element (25) at the free end, said piston being movable between two end-stroke positions.

4. Device according to claim 1, characterised in that said glue dispensing nozzles (41) are applied in fixed position with the axis substantially parallel to said transferring plane (51).

5. Device according to claim 1, characterised in that said handling group (30) comprises a curved lower plane (34) arranged immediately downstream of said lower handling roller (32) in a position below said transferring plane (51).

6. Device according to claim 5, characterised in that said detection means for detecting said end edge consist of photocells (42), suitable for detecting the presence of said end edge (11') on said curved plane (34), according to a predetermined length, to control the dispensing of glue and the rewinding of said end edge (11') by means of said handling rollers (31, 32).

* * * * *